US006901701B2

(12) United States Patent
Lee

(10) Patent No.: US 6,901,701 B2
(45) Date of Patent: Jun. 7, 2005

(54) MODULAR ASSEMBLED SHUTTER SET

(76) Inventor: Han-Sen Lee, 98-1, Show-Tsuo St. Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 39 days.

(21) Appl. No.: 10/457,980

(22) Filed: Jun. 9, 2003

(65) Prior Publication Data

US 2004/0244291 A1 Dec. 9, 2004

(51) Int. Cl.[7] ..... E06B 7/096; E06B 7/08
(52) U.S. Cl. ..... 49/82.1; 49/74.1
(58) Field of Search ..... 49/82.1, 74.1, 49/87.1, 403; 52/473

(56) References Cited

U.S. PATENT DOCUMENTS

| | | | | | |
|---|---|---|---|---|---|
| 2,835,001 | A | * | 5/1958 | Matthews | 52/473 |
| 4,936,048 | A | * | 6/1990 | Ruggles | 49/74.1 |
| 4,939,880 | A | * | 7/1990 | Wang | 52/473 |
| 5,216,837 | A | * | 6/1993 | Cleaver et al. | 49/82.1 |
| 5,379,551 | A | * | 1/1995 | Swapp | 49/82.1 |
| 6,145,251 | A | * | 11/2000 | Ricci | 49/82.1 |
| 6,314,680 | B1 | * | 11/2001 | Buckwalter et al. | 49/82.1 |
| 6,536,162 | B2 | * | 3/2003 | LaMay | 49/403 |
| 6,701,669 | B1 | * | 3/2004 | Yorgason | 49/82.1 |

* cited by examiner

*Primary Examiner*—Hugh B. Thompson, II
(74) *Attorney, Agent, or Firm*—Curtis L. Harrington

(57) ABSTRACT

A pre-cut, pre-painted shutter door includes a pair of vertical members available in a range of discrete or quantum heights, and having a two level slot along their length for engaging an upper and a lower panel to form the outer portions of a shutter door. Vertical members are preferably pre-tapped with bores to facilitate threaded member access to engagement for attachment to the upper and lower panels. The upper and lower panels have a curved surface to either facilitate direct manual pivoting of the louvers or to provide clearance for an optional common actuator bar. A louver pivot support fits within the two level slot of the vertical members and carries a series of pre-drilled holes for pivotally supporting the louvers. Both the vertical members, panels and louver member supports are of constant cross section to facilitate the use of finger joints and to promote continuous extrusion-type processing. A series of louvers have shafts which extend through pre-drilled holes in the louver pivot supports. Louver shafts may carry gears engaging a gears fittable within a clearance between the louver pivot supports and the more inner level of the two level slot to accommodate a gear rack engaging the gears of the louver shafts to provide simultaneous movement of the louvers with linear translation of the gear rack.

6 Claims, 6 Drawing Sheets

MODULAR ASSEMBLED SHUTTER SET

FIELD OF THE INVENTION

The present invention relates to an improvement in providing window covering shutter which are designed to be constructed from materials to give a more finished appearance with more balance in the shutter, including the ability to specify louver and side panel shutter door widths but without the loss of the professional look and without mistake, and expensive scrappage.

BACKGROUND OF THE INVENTION

Shutters which fold over window and door openings have been in use and have varying degrees of custom fit. In a typical window installation a poor quality of installation might include spacers which actually move the pivot point for the shutters and shutter sets toward the center of the assembly. This represents the worst solution to make up for a shutter set which is forced to fit a larger window.

In other more sophisticated assemblies the user can add decorative spacers to the shutter doors at either of their vertical sides with the whole shutter pivoting with respect to a window opening. Where the components for the typical unsophisticated user are provided in a pre-finished state, the unsophisticated user has an opportunity to "build out" by shims, shutter doors. The "build out" can be accomplished to keep a decorative horizontal balance in the shutter set.

Given the generally prominent vertical side rails which form the main structural components of the shutter doors, unsophisticated users have had little choice in determining the vertical height of individual shutter doors. Some vertical customizability can be had by specifying the border thickness of a support frame. However, this still restricts the opening the same as vertical blocks added to extend the pivot point of the shutters.

Although unsophisticated end users have been only partially empowered to perform good customization of self installed shutter sets using finished components, the goal of using finished components still holds a great deal of value for persons in the chain of sales and service from professional installers to manufacturers and assemblers. One of the main objectives is to enable as much cutting and painting to remain at the base manufacturing site. In other words, the key is to limit cutting to the original raw materials cutting which occurs at the factory using precision machines, and to limit painting to the professional, automated painting which occurs at the factory.

Looking at it from this viewpoint, most user constructable or modifiable shutter assemblies are configured to provide some activity on the part of the user or installer other than cutting and painting in order to provide matching with the ultimate user's window size. Further, because the user matching activities have been traditionally limited, the user's ability to affect the physical outcome of the shutter installation has also been limited. Much of the variation has been focussed upon obtaining a window opening fit, and thus the non-variable portion has centered upon the size of the louvers, and the area and shape of the louver space.

What is therefore needed is a further, deeper method of modularization which makes use of pre-cut and pre-painted components which can be user specified to not only match a given window opening, but which can be user specified to match more subtle user preferences.

SUMMARY OF THE INVENTION

A pre-cut, pre-painted shutter door includes a pair of vertical members available in a range of discrete or quantum heights, and having a two level slot along their length for engaging an upper and a lower panel to form the outer portions of a shutter door. Vertical members are preferably pre-tapped with bores to facilitate threaded member access to engagement for attachment to the upper and lower panels. The upper and lower panels have a curved surface to either facilitate direct manual pivoting of the louvers or to provide clearance for an optional common actuator bar. A louver pivot support fits within the two level slot of the vertical members and carries a series of pre-drilled holes for pivotally supporting the louvers. Both the vertical members, panels and louver member supports are of constant cross section to facilitate the use of finger joints and to promote continuous extrusion-type processing. A series of louvers have shafts which extend through pre-drilled holes in the louver pivot supports. Louver shafts may carry gears engaging a gears fittable within a clearance between the louver pivot supports and the more inner level of the two level slot to accommodate a gear rack engaging the gears of the louver shafts to provide simultaneous movement of the louvers with linear translation of the gear rack.

BRIEF DESCRIPTION OF THE DRAWING

The invention, its configuration, construction, and operation will be best further described in the following detailed description, taken in conjunction with the accompanying drawings in which.

DETAILED DESCRIPTION OF THE PREFERRED EMBODIMENT

Figure 1:
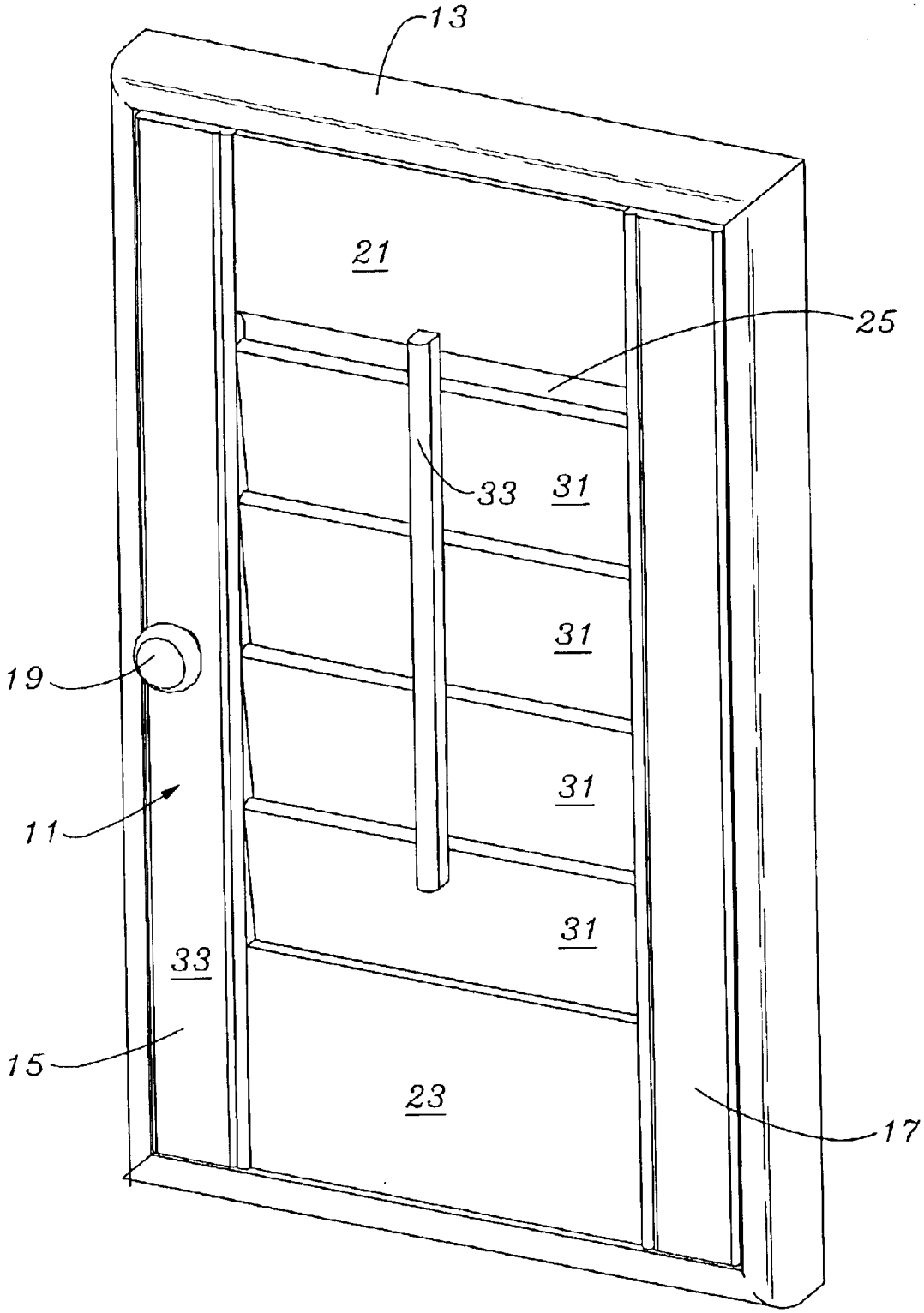
FIG. 1 is a basic view for reference and illustrating a single shutter in a frame.

The description and operation of the shutter system of the invention will be best described with reference to FIG. 1 which illustrates a perspective view of fundamental assembled shutter door 11 within a plain frame 13. The shutter door 11 includes a first vertical member 15 and a second vertical member 17. First vertical member 15 has a knob 19 used to open and close the shutter door 11. The second vertical member 17 typically has a hinge mount so that it can pivot with respect to the frame 13 or with respect to another shutter door 11.

The shutter door 11 has an upper panel 21 and a lower panel 23 which have side edges which connect to the first and second vertical members 15 and 17. Both the upper and lower panels 21 and 23 have a curved surface 25, which is seen only in the upper panel 21 of FIG. 1. The curved surface 25 of the lower panel 23 faces in the opposite direction.

Between the upper panel 21 and the lower panel 23, a series of louvers 31 are ultimately pivotally supported by the first and second vertical members 15 and 17. A common actuator bar 33 is connected to each of the louvers 31 by any number of types of pivoting connection assemblies including staple and eyelet, and eyelet to eyelet (not seen in FIGS. 1). These connections typically have a relationship between their size and orientation versus the degree to which the louvers 31 are enabled to pivot. Other factors include the thickness of the louvers and how they are oriented to interfit.

Conventional shutter doors typically have a small notch at the bottom edge of an upper panel to accommodate the upper end of the common actuator bar 33. This type of configuration usually requires a fixed system where the number and thickness and path of travel of the louvers 31 are known, where the pivotal attachment assemblies and their operation are known, and where the common actuator bar attachment and excess length is known. Further, the size and depth of the notch have to meet the size and depth travel of the common actuator bar in order to achieve a good fit.

Further note that typical louver orientation on shutter doors, including shutter door 11 are such that complete light blocking closure is had for movement of the common actuator bar 33 and louvers 31 in one direction such as the upward direction. The lower direction will typically not enable full closure and this position is typically used to direct light for light effect in a room. The curved surface 25 helps to accommodate the connection assembly between the common actuator bar 33 and the louvers 31, and provides a handy, easy to clean space for manual actuation of the louver 31 closest to one of the upper or lower panels 21 and 23.

The use of the curved surface 25 enables an aesthetically pleasing shape which accomplishes a number of objectives. By eliminating a point indentation along an otherwise constant cross sectional area member, one also eliminates the need to create an indentation, but more importantly the need to insure that it is centered with respect to the ultimate length of the upper panel 21 for the given configuration of shutter door 11 to be formed.

Further, the provision of a curved surface rather than a right angled internal surface facilitates cleaning. All of the surfaces of the elements including vertical members 15 and 17, knob 19, upper and lower panels 21 and 23 with their curved surfaces 25 and even the rounded series of louvers 31 are significantly rounded. There are no sharply angled corners within which dust may collect. A soft damp cloth could be used to completely wipe all the surfaces of the shutter door 11. There are not even corners of ninety degrees which would limit the ability to clean the shutter door 11.

Further, the simplification of the components of the shutter door system 11 also enables the use of finger joint techniques to construct lengths of the simplified components from shorter material lengths. Finger joint techniques can be advantageously employed to produce long continuous lengths of material without the ability to detect the existence or location of the finger joints in the finished material. Professional finishing, sanding and painting techniques at the manufacturing facility helps to insure a product with a smooth look.

With regard to the shutter door 11 seen in FIG. 1, and given that the orientation shown uses clearance on the reverse side of the lower panel 23 merely for clearance of the unobstructed bottom of the bottom most louver 31, the curved surface 25 of the lower panel 23 (not seen in FIG. 1) will work well. This, however, enables the use of an upper panel 21 which is of the exact same shape and width as lower panel 23. However, the height of the upper and lower panels 21 and 23 can be varied to accommodate more or less louvers 31, to accommodate a more vertically centered series of louvers 31 or a less vertically centered series of louvers 31.

Because the common actuator bar 33 extends to or above the upper extent of the curved surface 25 and does not lock into it, variation of the louvers 31 can be had with little or no effort. A larger number of much narrow louvers 31 could be substituted, as well as a lesser number of wider louvers 31. As will be seen the pivoting accommodation of the louvers 31 combined with the ability to select upper and lower panels 21 and 23 will ultimately give the user complete vertical specifiability of the louver door 11. Selection of the length of the upper and lower panels 21 and 23, louvers 31 and widths of the first and second vertical members 15 and 17 will enable a user to have complete control of the overall horizontal and vertical configuration of the shutter door 11.

It can be argued that any configuration for any shutter can be had by sizing, cutting, and then painting conventional structures, but this is not the case. The purpose for the components and structures of FIG. 1 is the provision of a series of components which are pre-cut and pre-painted and which differ by quantitized amounts to enable quantum combinations of components to yield a large but finite number of configuration.

The plain frame 13 can be chosen to have a width which may be available in quantum lengths to enable it to vary slightly, or by a quantum amount, with respect toany inexactitude with respect to the size of a window opening after the overall measurements are specified. These overall measurements respresent sums into which the individual measurements within which the first and second vertical members 15 and 17, upper and lower panels 21 and 23, and series of louvers 31 should fit.

Figure 2:
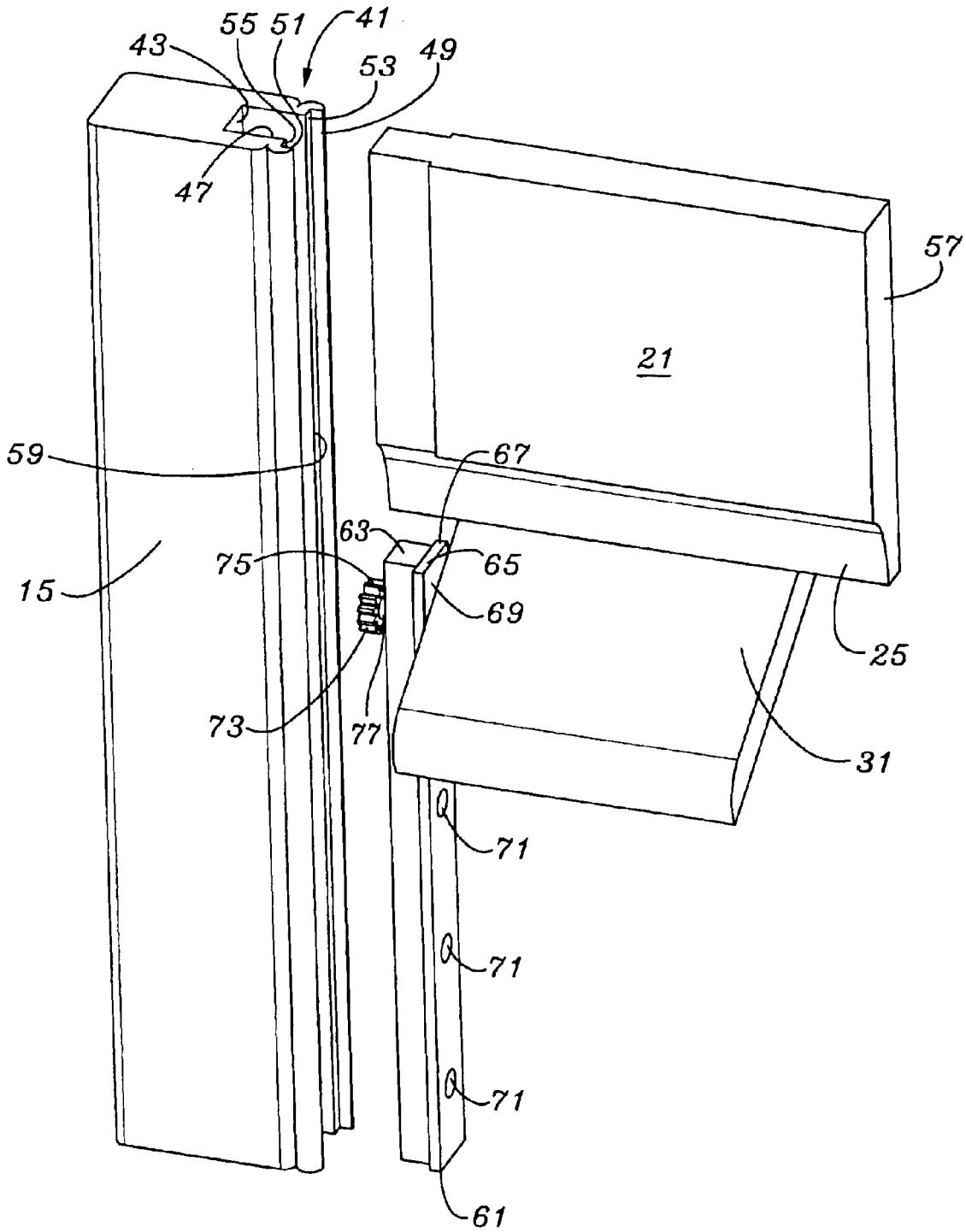
FIG. 2 is a gently exploded view of the upper left corner of the shutter door seen in FIG. 1 and which illustrates a number of components thereof.

Referring to FIG. 2, an exploded perspective view of the upper left side of the shutter 11 is seen. The first vertical member 15 (which is identical to the second vertical member 17) is seen as having a superimposed two level slot, simply referred to as two level slot 41. A pair of oppositely oriented surfaces provide support relatively outward of the two level slot 41, while a base, innermost surfaces provides support relatively inward into the two level slot 41.

The two level slot 41 serves double duty as a deep slot having a base 43 with side walls 45 and 47, and a wider shallow slot having abbreviated depth side walls 49 and 51 and adjacent bottom walls 53 and 55 which are immediately adjacent the side walls 45 and 47. The two level slot 41 could have been configured as a pair of different depth, non-symmetrical side by side slots or any other configuration which enables control of engagement tension, or creation of an accommodation space or general selection and control of the depth of engagement into the two level slot 41.

To the right of these structures an upper panel 21 has a flat end 57 and an optional tongue end 59. The optional tongue end 59 illustrates the use of a deep tongue structure which can extend somewhat deeply toward base 43. Conversely the flat end 59 can extend to the outer level and engage the adjacent bottom walls 53 and 55 adjacent the abbreviated depth side walls 49 and 51. Where bolts or screws are inserted into pre-tapped holes in the first vertical member 15 to engage the upper panel 21 or lower panel 23, spacers or force engagement members can be used to give good support and to save the slot 41 from opening or splitting.

Seen for the first time is a louver pivot support 61 having an overall "T" cross sectional shape and which fits into the slot 41. The "T" cross sectional shape has a base portion 63 which extends predominantly toward the base 43 of the two level slot 41 and a pair of side extensions 65 and 67 which form the "arms" of the "T" shape and which fit into the adjacent bottom walls 53 and 55 of the abbreviated depth side walls 49 and 51. A top surface 69 of the louver pivot support 61 contains a series of bores 71 which pivotally support the supports for the louvers 31.

By interfitting the louver pivot support 61 into the two level slot 41, the two level slot 41 is covered flush and it appears as if the inside or louver 31 directed surface of the first vertical member 15 is smooth and flush. The louver pivot support 61 is shown with flat ends to emphasize its structures and to emphasize that it need not be shape conforming to the bottom of the upper panel 21 and its curved surface 25. In the configuration shown, a tapering gap within the two level slot 41 between the top of the louver pivot support 61 and the curved surface 25 will exist. Alternatives include the shaping of the upper end of the louver pivot support 61 to complement and mate against the curved surface 25, or to make a square nick at the lower corner of the upper panel 21, the latter of which is not preferred. Since the upper versus lower extend of the louver pivot support 61 will meet "S" complementary curved surfaces 25, the ends of the louver pivot support 61 could be pre shaped to eliminate the gap.

Also seen in FIG. 2 is a mechanical extension 73 which includes a gear 75 supported by a shaft 77 and extending beyond the base portion 63. As such it can be seen that the depth of the base portion 63 falls short of the full distance to the base 42 to enable the gear 75 and shaft 77 to rotate within the resulting space.

Figure 3:
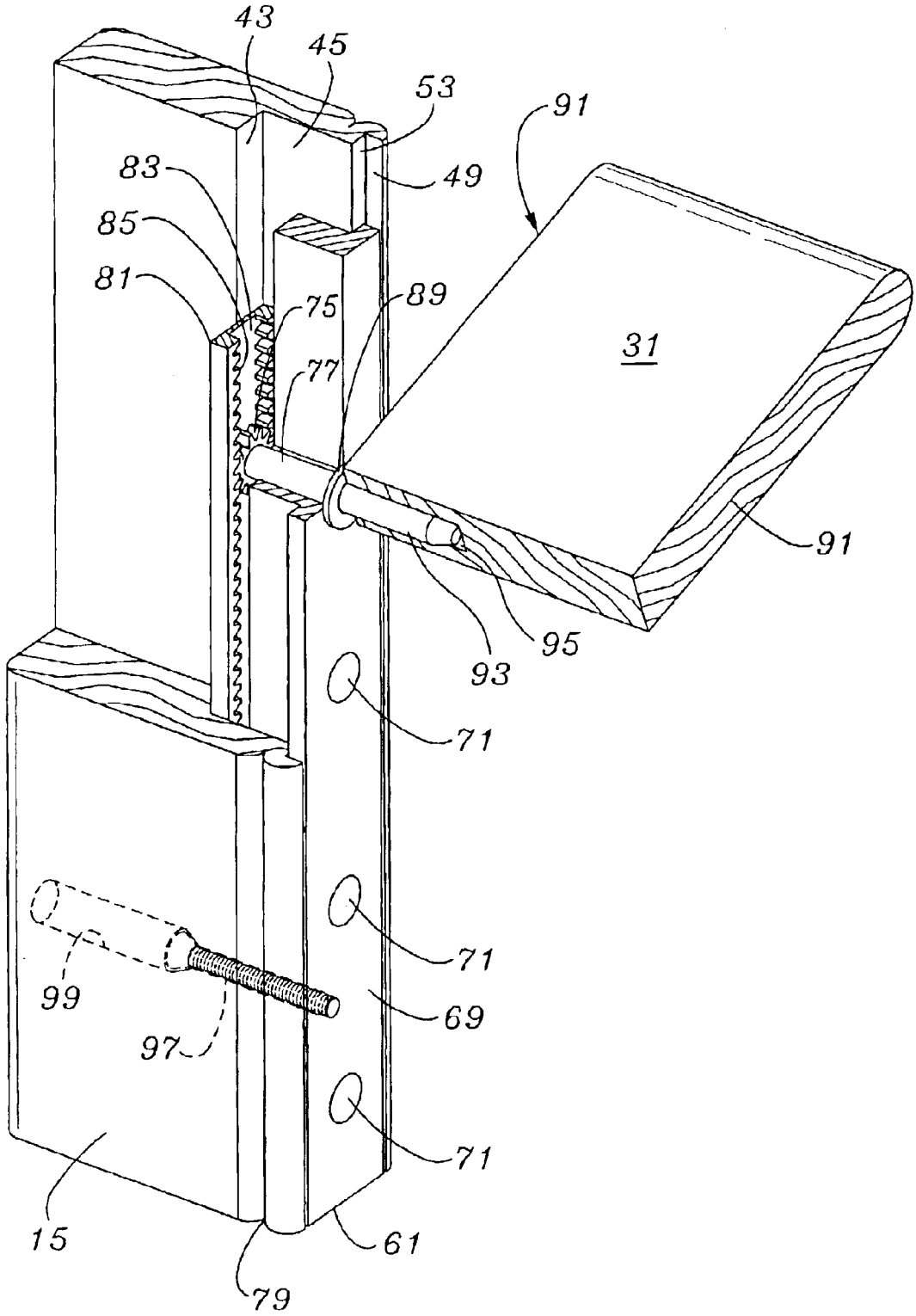
FIG. 3 is a partial sectional view of the components seen in FIG. 2 with the addition of optional components for operation of louvers.

Referring to FIG. 3, a perspective sectional view illustrates an optional rack an pinion setup as well as further details of the components seen in FIG. 2. The first vertical member 15 is seen as having a decorative groove 79. The space between the side walls 45 and 47 is occupied with the base portion 63 with enough room to closely fit a gear rack 81 having a slot 83 having a gear 85 to one side.

As stated earlier, the "superimposed" two level slot 41 is but one configuration of slot, and the gear rack 81 is but one configuration of a gear rack. Where a pair of connected slots having a deep surface adjacent a shallow surface is used, the gear rack might be completely linear and place on one of the sides of the deeper slot, for example.

In the configuration of FIG. 3, the turning of the gear 75 at the end of the shaft 77 will engage the gear 85 of the rack 81 and cause it to translate within the slot 41 and slide along the base 43. Recall that the range of movement of a louver is about one hundred forty to about one hundred fifty degrees, or about 40% of a circle. Where a gear 75 is an effective average of about one quarter inch in diameter, a one hundred fifty degree turn will cause a vertical translation of about 40% of about 0.78 inches or about 0.31 inches (7.97 mm).

This means that the end clearances for the rack 81 will need to be no more than about 8.0 millimeters. Further, the rack 81 can be fitted with slots to enable threaded members to extend through the vertical member 15 and engage the louver pivot support 61 at various points without interfering with the function of the rack 81. Where the louvers 31 are so attached to the shaft 77 that rotation of the louver 31 will not occur without the rotation of the louver 31, the louvers 31 and the rack 81 can be oriented together upon placement within slot 41 to eliminate the need for common actuator bar 33. In this case, a user would simply manipulate one louver 31 to turn all of the louvers 31 commonly adjacently connected. This would provide for a much greater aesthetic finish and eliminate a loosely operating member.

A thin washer 89 is seen as occupying the space between the top surface 69 of the louver pivot support 61 and the outside surface 91 of the louver 31. This will eliminate a straight material to material rubbing and will achieve better mechanical fit and motion. Note that the surface 69 might extend slightly beneath the extent of the abbreviated depth side walls 49 and 51 and that the thickness of the thin washer 89 can be used to make a close clearance between the outside surface 91 and the closest approach of the first vertical member in the direction of the outside surface 91.

Also seen is an insertion portion 93 of the shaft 77 which enters the louver 31 at a bore 95. The engagement of the insertion portion 93 and the bore 95 can be via gluing, threaded engagement, key and matching bore insertion and more. Also seen at a bottom breakaway portion is the insertion of a threaded member, such as a threaded member 97 through a bore 99 and into a solid portion of the louver pivot support 61. In this manner the louver pivot support can be locked tightly into the two level slot 41.

The series of bores 71 have been seen to work well with standard center to center spacings of two inches for louvers 31 having a width of slightly more than two inches to standard center to center spacings of three inches for louvers 31 having a width of slightly more than three inches. The slightly greater width is utilized to insure that there is sufficient overlap for light blockage and for limiting the effective angular range of turn for each louver 31 so that edge matching is not necessary.

Figure 4:
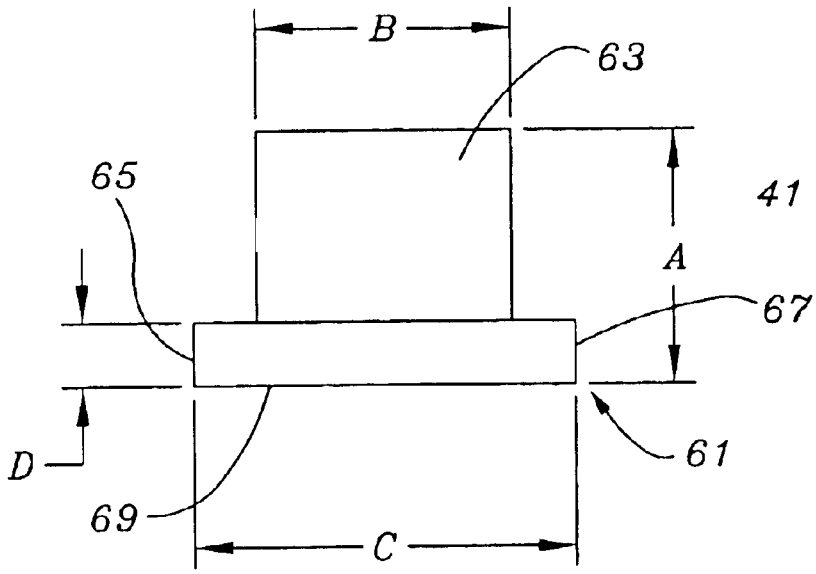
FIG. 4 is an end view of a louver pivot support carried by the first and second vertical members and illustrating a number of dimensional measurement quantities.

Referring to FIG. 4 an end view of the louver pivot support 61 is seen to illustrate one possible range of its dimensions. It may have a total depth "A" of about one half inch. The width of the base may have a width "B" of about one half inch. The width of the "T" portion is shown as having a dimension "C" of about three quarters of an inch. The thickness of the arms of the "T" section have a dimension "D" of about one eighth of an inch.

Figure 5:
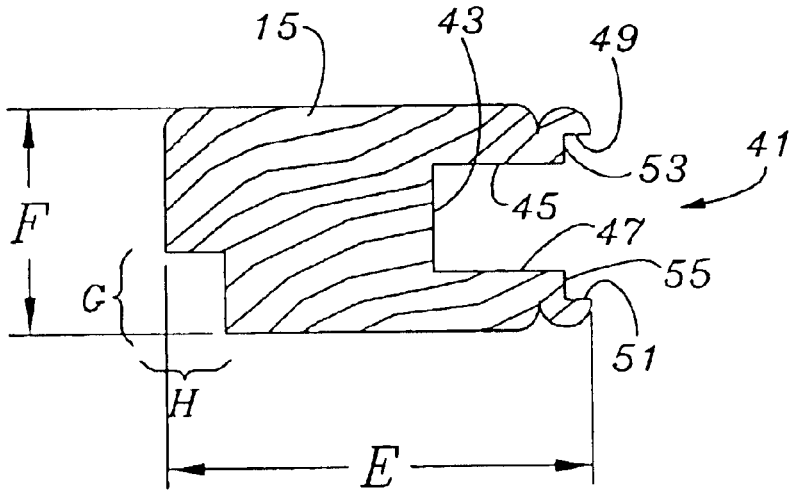
FIG. 5 is an end view of a first or second vertical member and illustrating a number of dimensional measurement quantities.

Referring to FIG. 5 an end view of the first vertical member 15 (which may be identical to the second vertical member 17) is seen to illustrate one possible range of its dimensions. It may have a total width "E" of about two inches. The thickness may have a dimension "F" of about one and one sixteenth inches. The other dimensions of the two level slot 41 are complementary to the external dimensions of the louver pivot support 61.

First vertical member 15 may have an optional notch 101 when it is used to form one of two overlapping shutter doors 11. Notch 101 has a dimension "G" of about nine sixteenths of an inch, and a dimension "H" of about one quarter of an inch.

Figure 6:
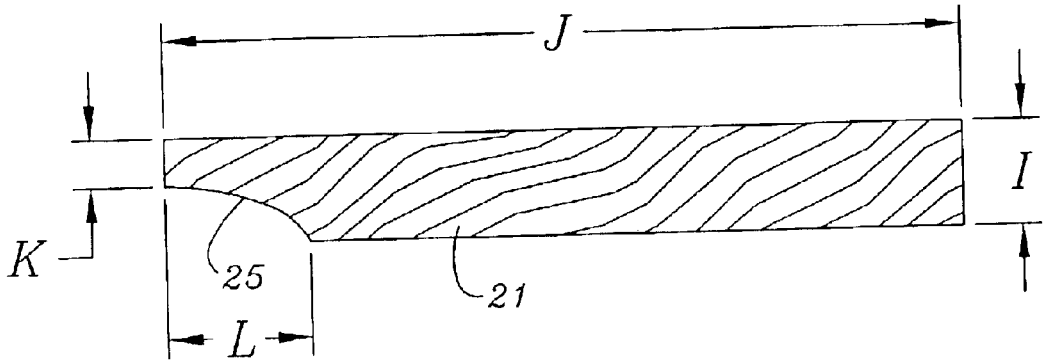
FIG. 6 is an end view of a upper or lower panel and illustrating the curved surface for either accommodating a common actuator bar or for facilitating manual opening of the louvers and illustrating a number of dimensional measurement quantities.

Referring to FIG. 6, a sectional view of the upper panel 21 (which is preferably identical to the lower panel 23) is seen. The upper panel 21 has a width of "I" of about one half inch, and a height "J" which is variable based upon the overall height needed for the panel. The curved surface 25 ends an abbreviated thickness end 103 having a width "K" of about "0.2" inches, slightly rounded. The depth of the curved surface 25 may preferably have a dimension "L" of about one inch.

Figure 7:
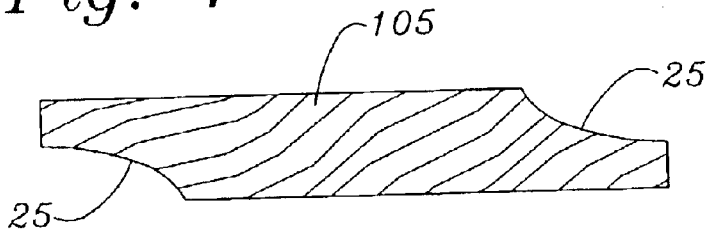
FIG. 7 is an end view of a divisional rail having a pair of curved surfaces.

Referring to FIG. 7, where it is desired to have a single division rail which separates two vertically stacked banks of louvers 31, a division rail 105 having a pair of curved surfaces 25 may be utilized. The oppositely oriented curved surfaces 25 are in the same orientation as was seen in FIG. 1 with curved surface 25 at the bottom of the bank (lower panel 23 in FIG. 1) would face oppositely to the curved surface 25 seen in the upper panel 21 of FIG. 1. Interposition of the division rail 105 would simply add a facing upper curved surface 25 for the next lower bank of louvers and a rearwardly facing upper curved surface for adjacency to the lowest louver 31 in an upper bank.

A typical louver 31 may vary in size but the preferred thickness is about three eighths of an inch. An end curvature protrusion from the end of the planar extent of the louver 31 of about one eighth of an inch is typical for the louver edge curvature extension. Two widths of louver 31 which have proven advantageous includes a first width of about three and three eighths inches and a second width of about two and three eighth inches.

Figure 8:
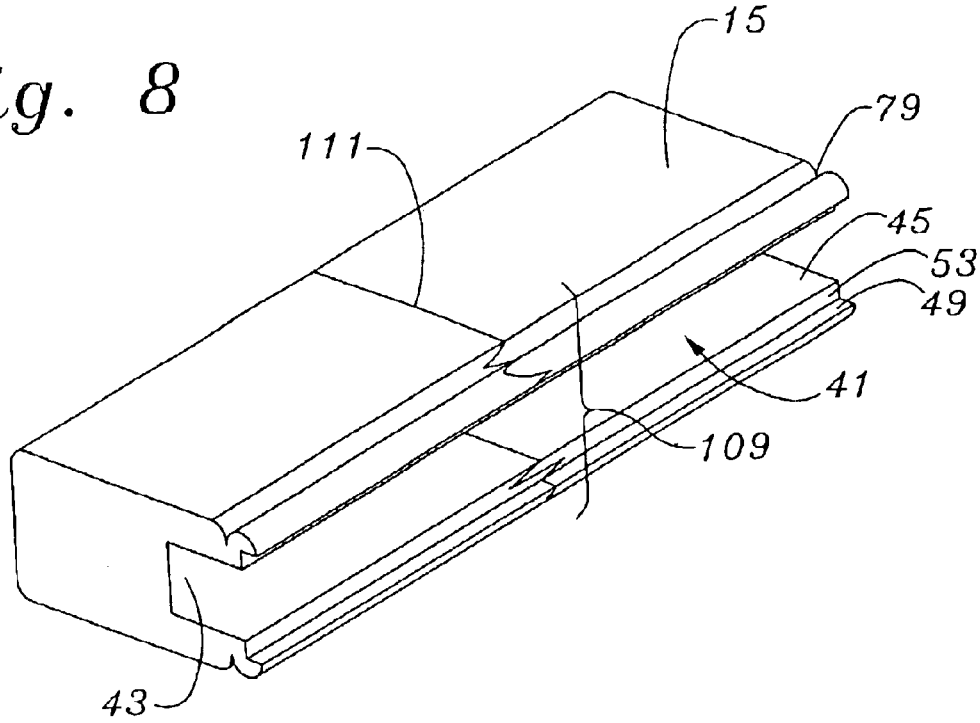
FIG. 8 is a perspective view of a section of first or second vertical member and illustrating an optimum method for utilizing finger joint construction.

Referring to FIG. 8, a perspective view of a short length of the first vertical member 15 illustrates a preferred method of use of finger joints with this component. After sections of whole wood are end cut to form interfitting finger joints 109, and after the finger joints are glued and joined, the member is sanded on the exterior surface to form a smooth surface and to minimize any smoothness deviation due to a joint boundary 111. Thereafter, the features including decorative groove 79 and two level slot 41 with its details including base 43, side walls 45 and 47, abbreviated depth side walls 49 and 51 and adjacent bottom walls 53 and 55 are formed.

Because the structure of FIG. 8 has a constant cross section, it may be routed internally and externally by linear feed through a precise machine. The first vertical member 15 may be cut into various lengths, preferably differing only by a small quantum amount. The overall length of the first vertical member 15 (and identical second vertical member 17) will set the height of the shutter door 11. The only other vertical quantum combinations to be considered are the vertical length of the upper and lower panels 21 and 23 in combination with the stack of pivotally mounted louvers 31, supported by lengths of selected louver pivot support 61.

Within the range of choices for the vertical combinations for the upper and lower panels 21 and 23 in combination with the stack of pivotally mounted louvers 31, the user can select the upper and lower panels 21 and 23 which approach evenness or which may have one much vertically larger than the other. Another combination the user can select is the use of more louvers 31 and lesser vertical height combined upper and lower panels 21 and 23 or a lesser number of louvers 31 and greater vertical height combined upper and lower panels 21 and 23. The play off between the heights of the upper and lower panels 21 and 23 and louvers 31 can also include selection of different sized louvers 31.

For a given desired vertical louver opening space the user can select a larger number of smaller louvers 31 or a lesser number of larger louvers 31, especially the width of the louvers 31. All of these variations can be specified by specifying the construction of pre-cut, pre-painted components. In other words the shutter door 11 assembly can be constructed with finished components.

Figure 9:
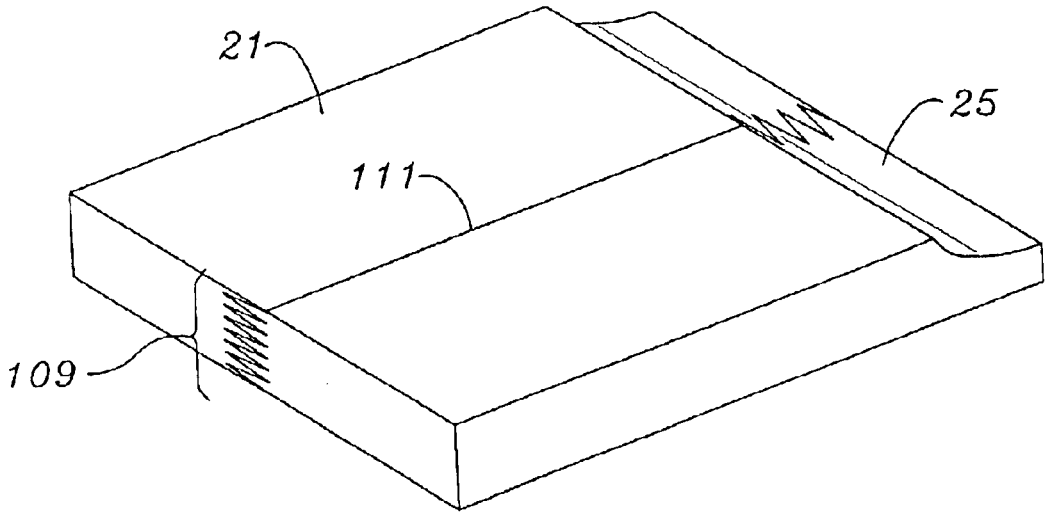
FIG. 9 is a perspective view of an upper or lower panel illustrating an optimum method for utilizing finger joint construction.

Referring to FIG. 9, a perspective view of a short length of the upper panel 21 illustrates a preferred method of use of finger joints 109 with this component. Again, after sections of whole wood are end cut to form interfitting finger joints 109, and after the finger joints 109 are glued and joined, the member is sanded on the exterior surface to form a smooth surface and to minimize any smoothness deviation due to a joint boundary 111. Thereafter, the features including curved surface 25 is formed.

Again, because the structure of FIG. 9 has a constant cross section, it may be routed internally and externally by linear feed through a precise machine. The upper panel 21 may be cut into various lengths, preferably differing only by a small quantum amount. The overall length of the upper and lower panels 21 and 23, along with the widths of the first and second vertical members 15 and 17 will set the width of the shutter door 11, with the lengths of the louvers 31 available to match the widths of the upper and lower panels 21 and 23.

The only other horizontal quantum combinations to be considered would possibly be different width first and second vertical members 15 and 17 or possibly the existence of notch 101 to form an overlap where two shutter doors 11 close. The only other consideration, not aesthetic, would be selection of the first and second vertical members 15 and 17 which are wide enough to insure structural integrity of the resulting shutter door 11 to hold its own weight and more. The horizontal width of the louver 31 opening will depend upon the combined widths of the first and second vertical members 15 and 17.

Within the range of choices for the horizontal combinations for the the upper and lower panels 21 and 23 the louver opening area can only be narrowed. Again, however the user can select the first and second vertical members 15 and 17 of different width for a different effect, although it is typical to choose first and second vertical members 15 and 17 for symmetry.

Figure 10:
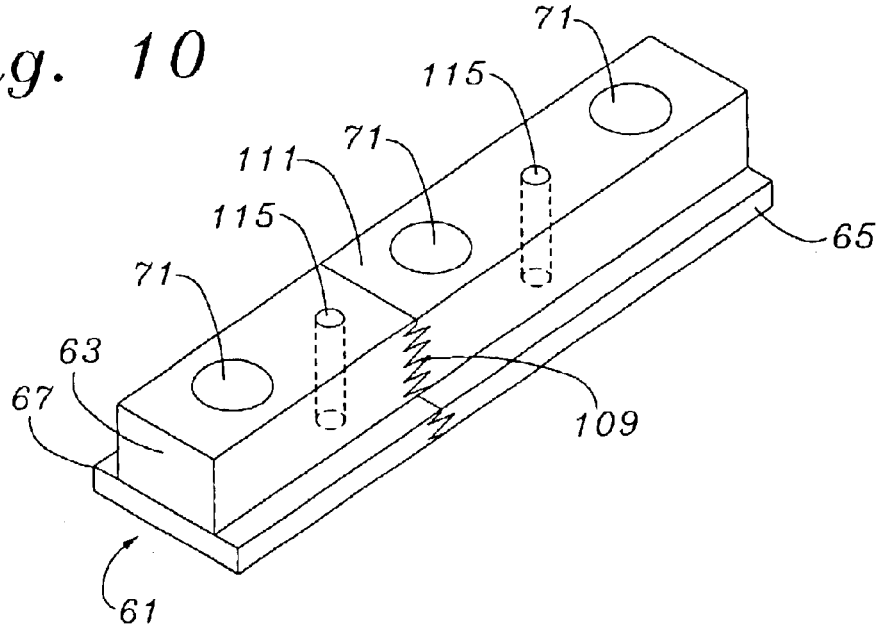
FIG. 10 is a perspective view of the louver pivot support illustrating an optimum method for utilizing finger joint construction.

Referring to FIG. 10, a perspective view of the louver pivot support 61 is seen and which illustrates a preferred method of use of finger joints 109 with this component. Again, after sections of whole plain wood are end cut to form interfitting finger joints 109, and after the finger joints 109 are glued and joined, the member is sanded on the exterior surface to form a smooth surface and to minimize any smoothness deviation due to a joint boundary 111. Thereafter, the features including base portion 63 (which may be selected for a depth to leave a clearance for the gear rack 81 within two level slot 41), as well as pair of side extensions 65 and 67 which are configured to engage the more outer engagement level of the two level slot 41. Also seen are bores 71 for pivotally supporting the shafts 77. In addition, pre-tapped bores 115 are seen which align with the bore 99 of the vertical members 15 and 17 to facilitate threaded member 97 reaching through the vertical members 15 and 17, and through the louver pivot support 61 and into engagement with the upper and lower panels 21 and 23.

Again, because the structure of FIG. 10 has a constant cross section, it may be routed externally by linear feed through a precise machine and it may be drilled with bores 71 and 115 in an automated fashion. The louver pivot support 61 may be cut into various lengths, preferably differing only by a small quantum amount with the locations of the bores 71 and 115 matching the bores 97 of the vertical members 21 and 23 with which it may be used. For a given size of vertical member 21 and 23, a longer louver pivot support 61 will accompany the use of a vertically taller bank of louvers 31 and a shorter pivot support 61 will accompany the use of a vertically shorter bank of louvers 31.

Again, all of the components for construction of the shutter door 11 are specified by specifying the construction of pre-cut, pre-painted components for both the vertical and horizontal sizes, and preferably those sizes differ by only a quantum amount so that the completed structure will differ with respect to a window opening by no more than that quantum difference amount. Any mismatch with the window opening can be made up by shimming the frame 13 with regard to a window opening.

Once the window opening is known, the next quantum size less of frame 13 is specified to give a known opening for the shutters. Once gross possibilities such as number of shutter doors to fit within the frame are selected, the user will probably be left with a number of design possibilities probably marshaled in accord with louver area size. Once the user selects the configuration, typically with computer assistance to rapidly select and illustrate the possibilities, the user's order will be filled by construction of louver doors from component bins which are already pre-cut and pre-painted.

Technicians select the first and second vertical members 15 and 17, upper and lower panels 21 and 23, series of louvers 31 (with or without gears 85 and gear rack 81), and louver pivot supports 61. Threaded members 97 are selected, possibly based upon the size of the first and second vertical members 15 and 17 and upper and lower panels 21 and 23, and the louver door 11 is assembled. The assembled door looks complete, flawless and brand new. The last step is the assembly of the frame 13 (which may also be available in bins according to exacting sizes and which may be assembled using threaded members) and the attachment of the shutter doors 11 into pivoting attachment relationship with the frame 13.

While the present invention has been described in terms of a system for enabling custom specification of a shutter set by providing minimal components and either accommodation of a common actuator bar 33 or elimination of an actuator bar 33 altogether to provide common internally linked louver movement, one skilled in the art will realize that the structure and techniques of the present invention can be applied to many structures, including any structure where construction methodology is facilitated by preconstruction sizing and finishing.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An shutter system comprising:

a first vertical member having a first two level slot of constant cross section extending between a first end and a second end, said first level of said first two level slot having a pair of spaced apart bottom walls, said second level of said first two level slot having a base width substantially even with an innermost extent of said spaced apart bottom walls;

a second vertical member having a second two level slot of constant cross section extending between a first end and a second end, said first level of said second two level slot having a pair of spaced apart bottom walls, said second level of said second two level slot having a base width substantially even with an innermost extent of said spaced apart bottom walls;

an upper panel having a first end engaged into at least said first level of said first two level slot and engaging at least said pair of spaced apart bottom walls of said first level of said first two level slot at said first end of said first vertical member and a second end engaged into at least said first level of said second two level slot and engaging at least said pair of spaced apart bottom walls of said first level of said second two level slot of said first end of said second vertical member, said upper panel having a curved surface and a substantially constant cross sectional area between said first and said second ends of said upper panel the curved surfaces extending into said first levels of the respective said two level slots;

a lower panel having a first end engaged into at least said first level of said first two level slot and engaging at least said pair of spaced apart bottom walls of said first level of said first two level slot at said second end of said first vertical member and a second end engaged into at least said first level of said second two level slot and engaging at least said pair of spaced apart bottom walls of said first level of said second two level slot of said second end of said second vertical member, said lower panel having a curved surface and a substantially constant cross sectional area between said first and said second ends of said upper panel the curved surfaces of said lower panel extending into said first levels of the respective said two level slots;

a first louver pivot support engaged through at least one level of said first two level slot between said first and said second ends of said first vertical member, said first louver pivot support having a first plurality of pivot bores for pivotally supporting angular louver movement;

a second louver pivot support engaged through at least one level of said second two level slot between said first and said second ends of said second vertical member, said second louver pivot support having a second plurality of pivot bores for pivotally supporting angular louver movement;

a plurality of louvers, each louver having a first end having a first pivot shaft engaging one of said first plurality of pivot bores and a second end having a second pivot shaft engaging one of said second plurality of pivot bores.

2. The adjustable shutter system as recited in claim 1 and further comprising a plurality of pre-drilled engagement bores in said first and said second louver pivot supports positioned to facilitate threaded member access into said upper and lower panels for engaging said first and said second louver pivot supports to said upper and lower panels.

3. The adjustable shutter system as recited in claim 1 wherein said first and second louver pivot supports have a "T" shaped cross section.

4. The adjustable shutter system as recited in claim 1 wherein said first louver pivot support has at least one surface for engaging an outer level of said first two level slot to create a first clearance between an inner level of said two level slot and said first louver pivot support.

5. The adjustable shutter system as recited in claim 1 wherein said pivot shaft of at least said first ends of said plurality of louvers have gears and further comprising a gear rack carried in said first clearance having a gear engaging said gears of said pivot shafts such that movement of one of said plurality of louvers moves said gear rack to cause at least one other of said plurality of louvers to move in concert.

6. The shutter system as recited in claim 1 and further comprising a common actuator bar attached to each of said plurality of louvers to simultaneously actuate said plurality of louvers.

* * * * *